United States Patent [19]

Barton et al.

[11] 4,269,925

[45] May 26, 1981

[54] POLYMERIC OPTICAL FILTER AGENTS AND PHOTOGRAPHIC PRODUCTS AND PROCESSES CONTAINING SAME

[75] Inventors: Derek H. R. Barton, Gif-sur Yvette, France; Irena Y. Bronstein-Bonte, Newton; Lloyd D. Taylor, Lexington, both of Mass.

[73] Assignee: Polaroid Corporation, Cambridge, Mass.

[21] Appl. No.: 89,558

[22] Filed: Oct. 29, 1979

[51] Int. Cl.[3] ..... G03C 1/40; G03C 1/84; G03C 5/54; G03C 1/10

[52] U.S. Cl. ..... 430/215; 430/221; 430/227; 430/236; 430/244; 430/434; 430/444; 430/448; 430/517; 430/519; 430/627

[58] Field of Search ..... 430/221, 522, 517, 519, 430/444, 448, 236, 434, 244, 215, 627, 227

[56] References Cited

U.S. PATENT DOCUMENTS

| | | | |
|---|---|---|---|
| 1,866,956 | 7/1932 | Tschunkur et al. | 260/556 B |
| 2,350,764 | 6/1944 | Jelly et al. | 430/512 |
| 2,497,526 | 2/1950 | Arnold | 8/55 |
| 2,763,566 | 9/1956 | Allan | 430/512 |
| 2,875,053 | 2/1959 | Minsk | 430/512 |
| 2,888,346 | 5/1959 | Tulagin et al. | 430/512 |
| 3,053,678 | 9/1962 | Mix | 106/165 |
| 3,414,650 | 12/1968 | Catino et al. | 424/60 |
| 3,573,287 | 3/1971 | Schorr et al. | 260/240 |
| 3,697,595 | 10/1972 | Clecak et al. | 260/556 R |
| 3,775,405 | 11/1973 | Bruce | 260/240 G |
| 3,953,211 | 4/1976 | Imai et al. | 430/225 |

FOREIGN PATENT DOCUMENTS 855901 12/1971 Belgium .

OTHER PUBLICATIONS

"Spectrophotometric Studies . . . ", Jones et al., *J. Org. Chem.*, vol. 25, 1960, pp. 226–231.

*Primary Examiner*—Richard L. Schilling
*Attorney, Agent, or Firm*—Louis G. Xiarhos

[57] ABSTRACT

Polymeric optical filter agents and photographic products and processes using same are disclosed. The polymeric optical filter agents are pH-sensitive optical filter agents comprising polymeric backbone units having the following hydrazone moiety:

where R is a group which can provide a double bond for conjugation with the portion of the moiety to provide light-absorbing capability for the agent at a pH above its pKa, and X represents a substituent of R providing at least one electron-withdrawing group. The polymeric pH-sensitive optical filter agents have a highly colored light-absorbing form at a pH above the pKa and are substantially non-absorbing at a pH below the pKa. The polymeric optical filter agents are useful in photographic film units and processes for the protection of photoexposed photosensitive elements against the occurence of fogging during in-light development.

71 Claims, 3 Drawing Figures

POLYMERIC OPTICAL FILTER AGENTS AND PHOTOGRAPHIC PRODUCTS AND PROCESSES CONTAINING SAME

BACKGROUND OF THE INVENTION

1. The Field of the Invention

This invention relates to photographic products and processes and particularly to diffusion transfer photographic products and processes.

2. Description of the Prior Art

Diffusion transfer photographic products and processes are known to the art and details relating to them can be found in U.S. Pat Nos. 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540, 3,569,333; 3,579,333; 3,594,164; 3,594,165; 3,597,200; 3,647,437; 3,672,486; 3,672,890; 3,705,184; 3,752,836; 3,857,865 and British Pat. No. 1,330,524.

Essentially, diffusion transfer photographic products and processes involve film units having a photosensitive system including at least one silver halide layer usually integrated with an image-providing material. After photoexposure, the photosensitive system is developed to establish an imagewise distribution of a diffusible image-providing material, at least a portion of which is transferred by diffusion to an image-receiving element having a layer capable of mordanting or otherwise fixing the transferred image-providing material. In some diffusion transfer products, the transfer image is viewed by reflection after separation of the image-receiving element from the photosensitive system. In other products, however, such separation is not required and instead, the transfer image in the image-receiving layer is viewed against a reflecting background usually provided by a dispersion of a white, light-reflecting pigment—such as titanium dioxide.

Diffusion transfer photographic products providing a dye image viewable against a reflecting background without separation are oftentimes referred to in the art as "integral negative-positive film units" and such units are of two general types. Integral negative-positive film units of a first type are described, for example, in the above-noted U.S. Pat. No. 3,415,644. Such film units include a photosensitive system and associated dye image-providing materials carried on an opaque support, an image-receiving layer carried on a transparent support and means for distributing a processing composition between the elements of the film unit. Photoexposure is made through the transparent support and image-receiving layer and a processing composition which includes a reflecting pigment is distributed between the image-receiving and photosensitive components. After distribution of the processing composition and before processing is complete, the film unit can be—and usually is—transported into conditions of ambient light to permit in-light processing.

Accordingly, in integral negative-positive film units of this type the layer provided by distributing the reflecting pigment must be capable of performing certain functions. For example, the distributed reflecting layer must be able to provide at least partial protection against further exposure of the photoexposed element if the film unit is transported into ambient light conditions before processing is completed. At the same time, however, the layer must be sufficiently permeable to permit effective transfer of image dyes from the photoexposed photosensitive layer or layers to the image-receiving layer. Moreover, after transfer, the layer must provide a reflecting background of suitable efficiency for viewing the dye image transferred to the image-receiving layer. Also, in film units of this type, the reflecting layer should effectively mask the photoexposed photosensitive layer or layers.

Integral negative-positive film units of a second type, as described, for example, in U.S. Pat. No. 3,594,165, include a transparent support, carrying the appropriate photosensitive layers and associated dye image-providing materials, a permeable opaque layer, a permeable light-reflecting pigment-containing layer, an image-receiving layer viewable through a transparent support against the light-reflecting layer, and means for distributing a processing composition between the photosensitive layer and a transparent cover or spreader sheet. Additionally, integral negative-positive film units of this second type include an opaque processing composition which is distributed after photoexposure to provide a second opaque layer which can prevent additional exposure of the photosensitive element.

In film units of this second type, exposure is made through the transparent cover sheet. After distribution of the processing composition and installation of the second opaque layer, this type of film unit can also be transported into light before processing is complete. Accordingly, in film units of this second type, the light-reflecting pigment-containing layer may also perform the functions of providing at least partial protection for the photoexposed element until processing is complete but again, this layer must permit effective transfer of image dyes to the image-receiving layer. Also, like the film units of the "first type", the layer must provide a suitable reflecting background for viewing the dye image transferred to the image-receiving layer. Moreover, effective masking of the photoexposed photosensitive layer must also be achieved for film units of this "second type."

In many known integral negative-positive film units, temporary opacification systems have been used in combination with light-reflecting layers and light-reflecting layer materials. These temporary opacification systems are designed to cooperate with the reflecting layer and/or reflecting layer materials to provide sufficient opacity to prevent further exposure of the film unit through the reflecting layer during processing of the film unit in light.

U.S. Pat. No. 3,647,437, for example, describes a temporary opacification system that has been used extensively in commercial integral negative-positive film units of the first type, e.g., film units of the type described in U.S. Pat. No. 3,415,644. That temporary opacification system essentially involves a pH-sensitive, optical filter agent which can absorb light at one pH but is rendered substantially non-light absorbing at another pH. As disclosed in U.S. Pat. No. 3,647,437, the optical filter agent is usually dispersed in the film unit's processing composition together with a light-reflecting pigment. In turn, the processing composition is integrated with elements of the film unit so that the composition can be distributed between the photoexposed photosensitive layer or layers and the image-receiving layer. Accordingly, after distribution of the processing composition, an opaque layer comprising reflecting pigment and optical filter agent is provided and the opaque layer covers a major surface of the photoexposed layers. This light-absorbing filter agent cooperates with the reflecting pigment to provide a reflecting layer having a degree of opacity sufficient to prevent photoexposure through the layer. As development and transfer of dye image material proceeds, the pH of the film unit changes so that the light-absorbing capability of the pH-sensitive optical agent is reduced until it becomes substantially non-light absorbing and its opacity providing function is diminished. When processing is complete, the reflecting layer—now comprising the reflecting pigment and decolorized optical filter agent—provides a white background for viewing the dye image and for masking the developed photoexposed layers.

Additional details relating the pH-sensitive optical filter agents useful in diffusion transfer photographic products and processes can be found in U.S. Pat. Nos. 3,702,244 and 3,702,245 among others.

SUMMARY OF THE INVENTION

This invention presents to the art novel polymeric pH-sensitive optical filter agents and novel photographic products and processes.

Broadly, the novel polymeric, pH-sensitive optical filter agents used in the film units of this invention are those having a hydrazone moiety attached directly or indirectly to the polymeric backbone. For the purposes of this invention, a hydrazone moiety is one providing or comprising the following structural formula:

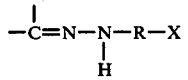

where R is any group which can provide a double bond for conjugation with the

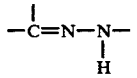

portion of the moiety to provide color for the moiety at a pH above the pKa of the moiety and X is a substituent of R providing at least one electron-withdrawing group.

The polymeric optical filter agents of this invention are pH-sensitive polymeric indicator dyes having moieties possessing spectral absorption characteristics which can be reversibly altered in response to changes in pH. The moieties integrated with the polymer have a highly colored form capable of absorbing visible radiation at a pH above the pKa of the moiety. However, the light-absorbing capability of the integrated moieties is substantially reduced (at least in the visible region) at a pH below the pKa of the moiety with the result that the moieties are substantially in a non-light absorbing form. For the purposes of this invention, pKa means the pH at which about 50% of the moiety is present in its light absorbing form and about 50% is present in its non-light absorbing form.

The structural moieties described above when integrated with the polymer—such as by attachment to the polymeric back bone—are believed to undergo the following changes in the presence of hydrogen and hydroxyl ions:

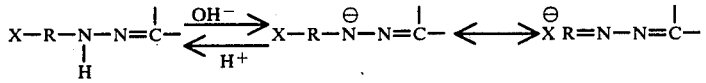

According to this invention, polymers comprising the structural moiety described above are particularly suitable for protecting photoexposed diffusion transfer film units from fogging that can occur during development of the film unit in light. Polymers comprising the structural moiety can absorb radiation within wavelength ranges of the visible spectrum and polymers comprising individual structural moieties or polymers comprising combinations of them can be used alone or in combination with other known pH-sensitive, optical filter agents to provide absorption effective over a preselected range or region of the visible spectrum.

The invention, as well as details relating to the manners of making and using it, will be more fully appreciated by reference to the following description of the preferred embodiments taken in connection with FIG. 1.

DESCRIPTION OF THE PREFERRED EMBODIMENTS

The preferred film units of the present invention are integral negative-positive film units of the type described in such patents as U.S. Pat. Nos. 3,415,644 and 3,647,437.

Figure 1:
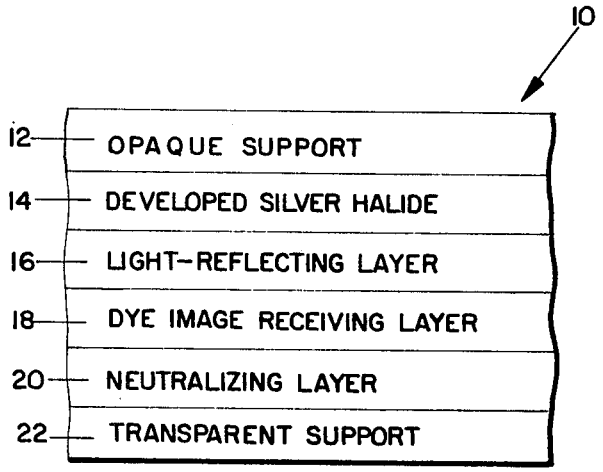
FIG. 1 is a simplified or schematic view of an arrangement of essential elements of preferred film units of the present invention, shown after exposure and processing.

Referring now to FIG. 1, there is shown a film unit of the type referenced in U.S. Pat. Nos. 3,415,644 and 3,657,437 following exposure and processing. The film unit 10 includes opaque support 12 carrying a photosensitive system 14 and a light-reflecting layer 16 comprising a light-reflecting pigment and a polymeric pH-sensitive optical filter agent of this invention. Initially, the mixture of light-reflecting pigment and the polymeric optical filter agent is dispersed in an aqueous alkaline photographic processing composition retained in a rupturable container (not shown). After photoexposure of photosensitive system 14 through transparent support 22 and image-receiving layer 18, the processing composition is distributed between layers 14 and 18.

When the processing composition is distributed over the photosensitive layer 14, a light-reflecting layer 16 comprising the mixture of the light-reflecting pigment and polymeric, pH-sensitive, optical filter agent of this invention is provided between image-receiving layer 18 and photosensitive layer 14. During at least the initial stage or stages of processing, this layer is subjected to an environmental pH which is above the pKa of the polymeric optical filter agent, and under such pH conditions, the optical filter agent is light-absorbing. Accordingly, during this state of processing, the polymeric, light-absorbing optical filter agent cooperates with the light-reflecting pigment to provide a layer presenting sufficient opacity to protect the photosensitive system of layer 14 from further photoexposure through transparent support 22. The processing composition initiates development of photoexposed photosensitive layer or layers 14 in manners well known to the art to establish an imagewise distribution of diffusible image-providing material which can comprise silver and/or one or more dye image-providing materials. The diffusible, image-providing material is transferred through permeable, light-reflecting layer 16 where it is mordanted, precipitated or otherwise retained in known manner in or on image-receiving layer 18 to provide a transfer image viewable through transparent support 22 against light-reflecting layer 16.

Film units of the type shown in FIG. 1 include means to reduce the pH of the film unit to a predetermined level. The means to effect this reduction in pH is shown in FIG. 1 as a substantially transparent polymeric acid, neutralizing layer 20 of the type described in U.S. Pat. No. 3,415,644. Preferably, the polymeric acid, neutralizing layer 20 is used in combination with a spacer or timing layer (not shown) positioned between polymeric acid neutralizing layer 20 and image-receiving layer 18.

Polymeric acid neutralizing layer 20 is designed to function after distribution of the aqueous alkaline processing composition. After a predetermined period, alkaline reagents diffusing to and contacting polymeric acid layer 20 will be neutralized. This neutralization continues until the environmental pH of the film unit is reduced to a predetermined value—preferably to a pH of about 5 to 8. In any event, the neutralization is sufficient to at least reduce the environmental pH of the polymeric optical filter agent to a pH below the pKa value of the polymeric optical filter agent in layer 16. At this reduced pH, the light-absorbing capability of the polymeric, pH-sensitive, optical filter agent is reduced and becomes substantially non-absorbing of visible light. Accordingly, the finished processed film unit has a light-reflecting layer 16 which comprises the light-reflecting pigment and the polymeric optical filter agent in its substantially non-light absorbing form. Layer 16 therefore provides a background for viewing the image in layer 18 through transparent polymeric acid layer 20 and transparent support 22. Also, layer 16 effectively masks photoexposed photosensitive layer(s) 14.

Suitable photosensitive systems employed in the film units described above are well known to the art and they include those providing silver images as well as color and multicolor images, as set forth in detail in the various patents cross-referenced here. The most preferred systems are multilayer systems involving a blue-, a green- and a red-sensitive silver halide layer integrated respectively with a yellow, a magenta, and a cyan dye image-providing material.

The polymeric, pH-sensitive optical filter agents of this invention are polymers having the following structural moiety attached directly or indirectly to the polymer:

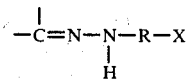

where as mentioned, R is any group or radical which can provide a double bond for conjugation with the

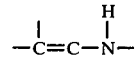

portion of the moiety to provide color (or a visible-light absorbing capability) for the moiety at a pH above the pKa of the moiety and X is a substituent of R providing at least one electron-withdrawing group. In general, preferred polymeric pH-sensitive optical filter agents of the invention will comprise recurring polymeric backbone units having pendant moieties containing the hydrazone structure as hereinbefore defined.

Preferred R groups or radicals are those providing a carbon-to-carbon double bond (—C=C—) for the requisite conjugation. Representative preferred R groups or radicals can be illustrated by the following structural formula:

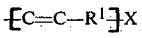

where $R^1$ represents an acyclic, saturated or unsaturated, branched or unbranched hydrocarbon moiety or $R^1$ can represent or include a saturated or unsaturated carbocyclic or heterocyclic ring structure. X, as mentioned, represents at least one electron-withdrawing group substituent attached to at least one of the carbon or hetero atoms of the R group or radical.

Preferred R groups or radicals, shown with an attached electron-withdrawing group, X, are those conforming to the following structural formula:

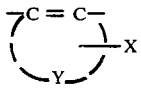

where Y represents the atoms necessary to complete a carbocyclic or heterocyclic ring structure or a fused polycyclic ring structure having carbocyclic or heterocyclic rings or mixtures of such rings. Especially preferred R groups or radicals are the divalent aromatic radicals, e.g., phenylene, biphenylene, tetraphenylene, naphthylene and the like. Heterocyclic R radicals suitable herein are those wherein Y comprises the atoms necessary to complete the heterocyclic ring structure. Thus, radicals derived from furan, pyran, imidazole, pyrrole, carbazole or the like can be suitably employed as R radicals where such radicals provide a double bond for conjugation with the

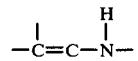

portion of the

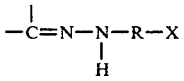

moiety and provision of color or light-absorbing capability above the pKa of the optical filter agent and where the polymeric optical filter agent is rendered substantially colorless at a predetermined pH below the pKa thereof.

Broadly, suitable X substituents of R in the above formulae may be any electron-withdrawing group having a positive sigma value as defined by Hammett's Equation and capable of providing a stable anionic resonating structure. Such groups are well known to the art and exemplary Hammett values and procedures for their determination are set forth by J. Hine in Physical Organic Chemistry, 2nd Edition, p. 87, published in 1962; by H. VanBekkum, P. E. Verkade and B. M. Wepster in Rec. Trav. Chim, Volume 78, Page 815, published in 1959; by P. R. Wells in Chem. Revs., Volume 63, Page 171, published in 1963; by H. H. Jaffe, Chem. Revs., Volume 53, Page 191, published in 1953; by M. J. S. Dewar and P. J. Grisdale in J. Amer. Chem. Soc., Volume 84, Page 3548, published in 1962; and by Barlin and Perrin in Quart. Revs., Volume 20, Page 75 et seq., published in 1966. Suitable X groups herein include, for example, nitro, carboxy, trifluoromethyl, sulfonyl ($-SO_2-R^2$ where $R^2$ may by halogen, alkyl, aryl, alkaryl acyl and their substituted derivatives, particularly their halogen substituted derivatives and especially their fluoro substituted derivatives).

Especially preferred polymeric, pH-sensitive optical filter agents are polymers comprising a moiety of the following structure:

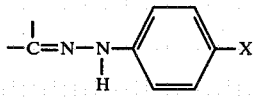

where X is

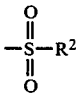

or at least one $-NO_2$ or at least one halogen.

Moieties of the above preferred structural formula can be integrated with polymeric materials by reacting a hydrazine with a suitable integral functional group of the polymer. Particularly suitable functional groups are carbonyl groups which can be located in the polymeric backbone but preferably are part of a moiety pendant from the backbone. Hydrazines suitable for preparing polymeric optical filter agents comprising the above structure are those of the following general formula: $NH_2NH$-R-X and preferably those of the following formula:

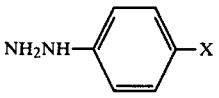

Specific suitable hydrazines include the following:

A. 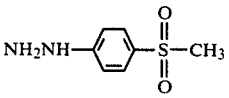

-continued

B. 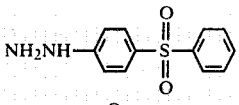

C. 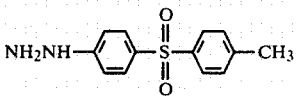 ;

D. 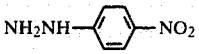 ;

E. 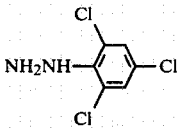 ;

F. 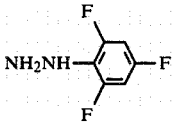 ;

G. 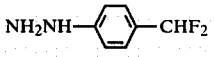 ;

H. 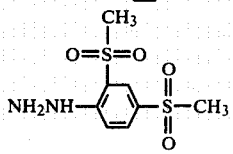 ; and

I. 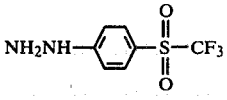 .

The polymeric pH-sensitive optical filter agents of the invention can be suitably prepared by reaction of a hydrazine compound as hereinbefore described with a polymeric material having functional sites, e.g., carbonyl groups, for reaction with the hydrazine compound or a mixture of such compounds. Thus, there can be employed herein a variety of polymeric materials comprising recurring units having functional groups capable of reaction with a suitable hydrazine compound with the production of a polymeric indicator dye or optical filter agent exhibiting light-absorbing properties at a predetermined pH above the pKa of the optical filter agent and substantially non-absorbing properties with respect to visible light at a predetermined pH below the pKa thereof. Polymeric materials comprising, for example, recurring backbone units having pendant chains with carbonyl groups can be employed for this purpose with the provision of polymeric optical filter agents having the pH-sensitive and controllable light-absorbing and non-absorbing properties herein described. Inasmuch as the polymeric optical filter agents hereof should be stable and suitably dispersible or soluble in an aqueous, alkaline processing composition, suitable polymeric precursor materials of such optical filter agents can be utilized having in mind these desirable properties. Preferred polymeric optical filter agents hereof are those which exhibit viscosity-increasing or thickening properties while allowing diffusion therethrough of image-providing materials such as diffusable dyes. Polymeric precursor materials of suitable molecular weight and film-forming properties can be employed herein for derivatization with a hydrazine compound with provision of polymeric optical filter agents having such properties.

Particularly suitable polymers for preparing the optical filter agents of this invention are those providing a

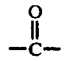

functional group as part of the backbone of the polymer but preferably pendant from the polymeric backbone. Particularly preferred polymers are those providing backbone units of the following structure:

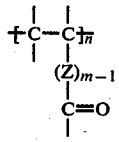

where

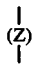

is a divalent radical linking the

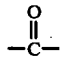

group to the backbone; m may be 1 or 2 and n represents the molar proportion of the shown backbone unit in the polymer chain.

Preferred polymers for preparing the optical filter agents of this invention are polymers of diacetone acrylamide, particularly those providing backbone units of the following structure:

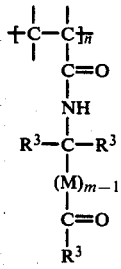

where each $R^3$ is the same or different alkyl of 1 to 6 carbon atoms, preferably methyl or ethyl; M is an alkylene radical having 1 to 8 carbon atoms and may be straight or branch chained; and m is either 1 or 2.

Other preferred polymers for preparing the polymeric optical filter agents of this invention are polymers of vinyl alkyl ketones comprising the following recurring units:

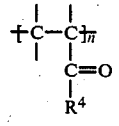

where $R^4$ represents alkyl, for example, alkyl of from 1 to 6 carbon atoms and n represents the molar proportion of the shown recurring units in the polymer.

Especially preferred polymers for the practice of the present invention are the partial oximes of the described polymers of diacetone acrylamide and of vinyl alkyl ketones. These partial oximes comprise the

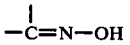

substituent and provide polymers having backbone units of the following structures.

PARTIAL OXIMES OF DIACETONE ACRYLAMIDES

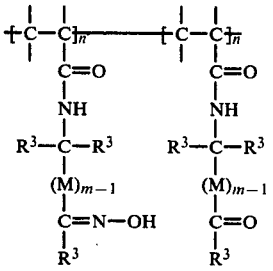

wherein $R^3$, M and m have the meanings hereinbefore defined and wherein n' and n represent the respective molar proportions of the shown recurring units of the polymer.

PARTIAL OXIMES OF VINYL ALKYL KETONES

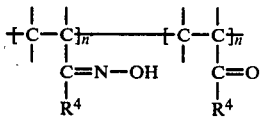

where $R^4$ is alkyl of from 1 to 6 carbon atoms and n' and n represent the molar proportions of the shown recurring units of the polymer.

The partial oximes of poly(diacetone acrylamides) are particularly preferred starting materials for the novel, pH-sensitive, polymeric optical filter agents of this invention. These partial oximes are highly stable and soluble in aqueous alkali processing compositions and provide viscosity-increasing and film-forming performance characteristics. Details relating to the preparation of oxime-containing polymers and their utilization as viscosity-increasing agents in photographic processing compositions can be found in commonly assigned U.S. Patent Application Ser. No. 894,545 filed Apr. 7, 1978 by Lloyd D. Taylor.

The polymeric pH-sensitive optical filter agents of the present invention can be in the form of homopolymers or copolymers. Suitable copolymeric optical filter agents include graft and block copolymers having the hereinbefore defined

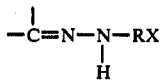

moiety. As has been previously mentioned, the pH-sensitive optical filter agents of the invention can be conveniently prepared by reaction of a suitable hydrazine compound with a polymer having recurring carbonyl sites for hydrazone derivatization. Thus, homopolymers comprising recurring backbone units having pendant carbonyl groups can be suitably employed as polymeric precursor materials of the hydrazone polymeric optical filter agents of the invention and examples of such precursor materials include the homopolymers of diacetone acrylamide as mentioned hereinbefore. Similarly, copolymeric materials can be suitably utilized for the provision of optical filter agents of the invention. For example, copolymers of diacetone acrylamide and vinylic monomers such as acrylic acid, vinyl acetate or the like can be utilized for derivatization with a suitable hydrazine compound and formation of a pH-sensitive optical filter agent as herein described. Block copolymers and graft copolymers having carbonyl groups as backbone or pendant moieties for reaction with a suitable hydrazone compound can also be employed in the production of pH-sensitive optical filter agents of the invention.

The provision of the novel polymeric, pH-sensitive optical filter agent of this invention by reaction of a hydrazine compound with a polymeric precursor material having reactive carbonyl groups can be illustrated by the following simplified general reaction scheme:

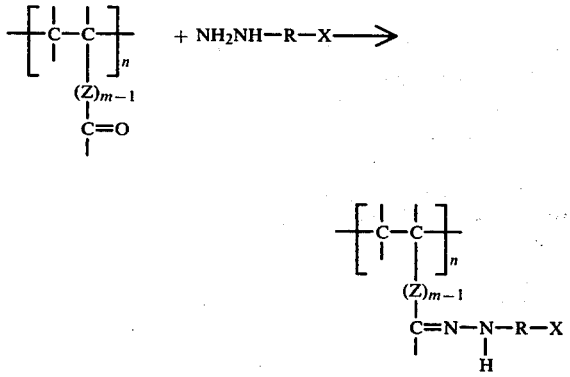

where Z, R, X and m are as defined hereinbefore and n represents the molar proportion of the shown recurring unit in the polymer.

Preparations involving reactions between preferred polymeric oximes and preferred hydrazines can be illustrated by the following reaction scheme:

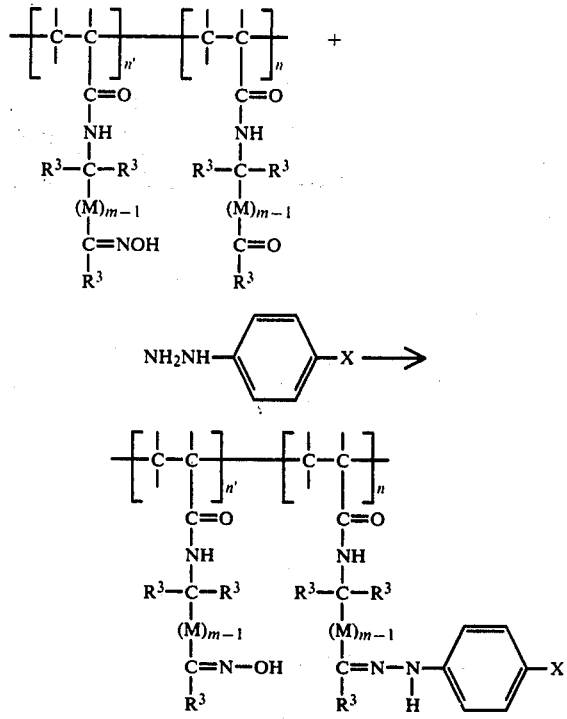

wherein $R^3$, M, X and m have the meanings hereinbefore defined and n' and n represent the respective molar proportions of the shown recurring units in the polymer.

The following polymeric, pH-sensitive, optical filter agents are examples of optical filter agents of the invention which can be prepared according to the above illustrative reaction schemes. In the optical filter agents set forth as follows, n' and n represent the respective molar proportions of the shown recurring units of the polymer. It will be appreciated that, depending upon the particular optical filter agent utilized and the particular solubility or other characteristics desired, n' and n can be varied accordingly, thus, in the structures shown, the recurring units containing the hydrazone moieties, represented by n, can, for example, comprise from about 5 to about 80 mole percent of the copolymer. Accordingly, in the copolymers shown, the molar proportion of the oximated recurring units, represented by n', would comprise the balance to 100 mole percent, i.e., (100−n)%.

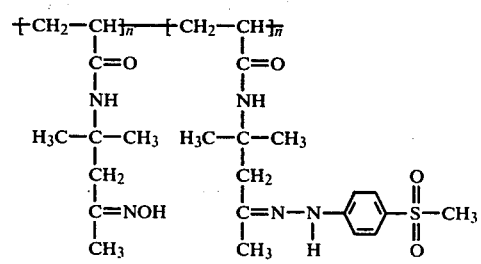

-continued

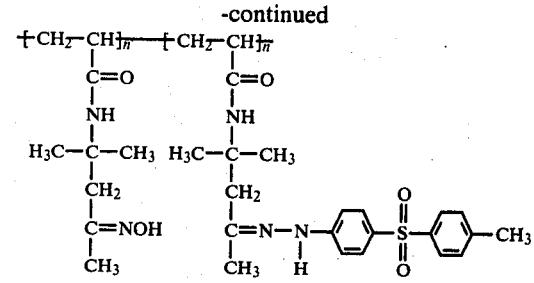

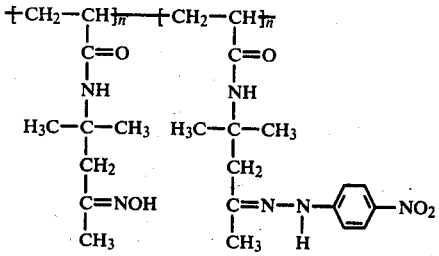

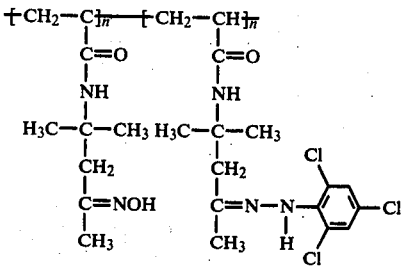

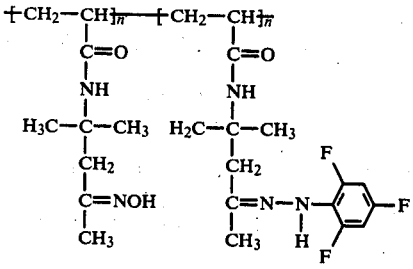

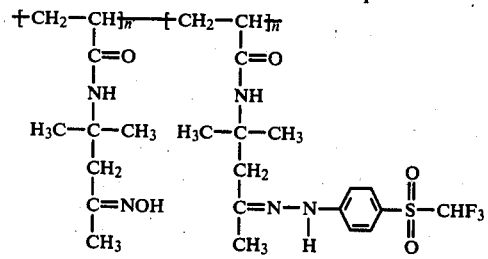

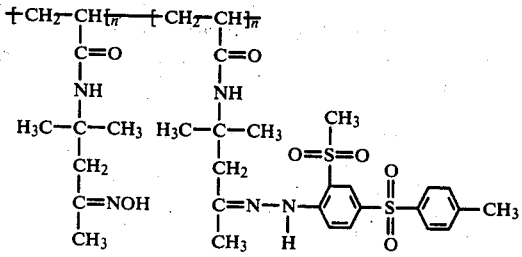

Other polymeric, pH-sensitive optical filter agents of the present invention illustrative of those having recurring hydrazone-containing units, oximated units and recurring units of a comonomeric vinylic compound are set forth as follows. In the following structures, n, $n^1$ and $n^2$ represent the respective molar proportions of such units in the copolymer and can vary. Thus, n can, for example, be in the range of from about 20 to about 60 mole percent while $n^1$ represents from about 40 to 60 mole percent and $n^2$ represents the balance to 100 mole percent, i.e., $[100-(n+n^1\%)]$.

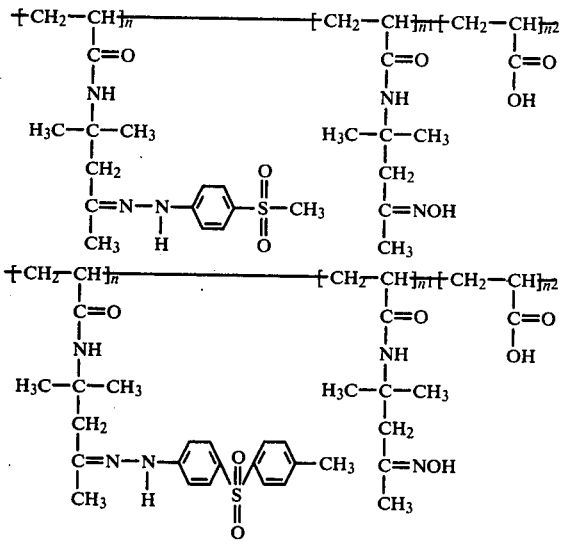

The polymeric, pH-sensitive, optical filter agents of this invention are preferably used in diffusion transfer film units as pH-sensitive optical filter agents and manners of using them are known to the art. As mentioned, the primary function of optical filter agents is to provide temporary opacification during processing of a photoexposed film unit. In turn, this function must be accomplished without interfering with photoexposure of photosensitive layer(s) or with viewing the final image. Accordingly, the polymeric optical filter agents of this invention can be utilized in a layer of the film unit between the photosensitive layer(s) and a layer through which the photosensitive layer(s) is exposed. When employed in such a layer, the polymeric, optical filter agent should be maintained at a pH at which the polymeric optical filter agent is substantially non-light absorbing (colorless). After photoexposure, and as the aqueous alkaline processing composition is applied to the polymeric optical filter agent-containing layer, the polymeric optical filter agent will be rapidly converted to a light-absorbing form (colored) to assume its opacification function. If the polymeric optical filter agent-containing layer is positioned so that it may interfere with viewing the image, the polymeric optical filter agent can be converted in known manners—to the non-light absorbing form. If conversion means are not available, the polymeric optical filter agent-container layer should be positioned so that the layer is hidden after image formation. For example, the layer can be hidden by the reflecting layer masking the photoexposed layers. In a preferred practice of this invention, the polymeric, pH-sensitive optical filter agent is included in the aqueous alkaline processing composition with the light-reflecting pigment or agent. The use of the polymeric, pH-sensitive optical filter agent in the processing composition is especially preferred if the polymeric material involved has a viscosity-increasing and/or film-forming capability such as the partial oximes mentioned before. In this embodiment, the polymeric optical filter agent is light absorbing (colored) in the distributed processing composition providing the light reflecting layer and remains sufficiently light absorbing during formation of the image to provide the degree of opacification required of the distributed light-reflecting layer. Thereafter, the polymeric filter agent is converted to a form exhibiting a substantially reduced light-absorbing capacity as the pH of the reflecting layer is adjusted to a value below the pKa of the polymeric filter agent. Once converted to its diminished light-absorbing form, the position of the polymeric filter agent with respect to the viewable image is not especially critical. It can, for example, be in front of the light-reflecting layer or preferably in the light-reflecting layer. In this preferred embodiment, the polymeric filter agent used should have good stability in aqueous alkali processing compositions and a high pKa e.g., a pKa of 11 or more.

The polymeric optical filter agents of the present invention exhibit a substantial reduction in light-absorbing capacity upon conversion from a highly colored form at a pH above the pKa thereof to a pH below the pKa. Relative to the highly colored forms, the optical filter agents of the present invention are, thus, substantially non-absoring in the visible region of the electromagnetic spectrum. Preferably, the optical filter agents will be colorless at a pH below the pKa and, accordingly, will be especially suited to the provision of a white or substantially white background for viewing of the transferred photographic image. Depending, however, upon the particular optical filter agent employed, the nature of substituent moieties present which may contribute light-absorbing capacity, on the concentration of such optical filter agent employed in a light-reflecting layer, a light-reflecting layer containing an optical filter agent of the invention may exhibit a coloration in its relatively and substantially non-absorbing form. The optical filter agents in their highly colored form provide, however, substantial protection of photosensitive elements agains post-exposure fogging.

The particularly preferred light-reflecting pigment for film units of this invention is a titanium dioxide. In general, the coverage of the titanium dioxide should be such as to provide a percent reflectance of about 85–95%. Particularly preferred processing compositions for the abovedescribed preferred embodiment and including the preferred titanium dioxide are those additionally having enough pH-sensitive indicator dye to provide—on distribution—a layer having an optical transmission density $> \sim 6.0$ density units and an optical reflection density $< \sim 1.0$ density units at a pH above the pKa of the optical filter agent(s).

The concentration of the polymeric optical filter agent(s) of this invention used in film units to provide the desired opacification may be readily determined by routine testing. The concentration selected should be sufficient to provide—in combination with other layers between the photosensitive layer(s) and incident radiation—an optical transmission density sufficient to prevent the unwanted fogging during processing. The concentration of the polymeric optical filter agent(s) will, of course, vary as a function of, e.g., processing time, light intensity and exposure index. In general, the opacification system should provide an optical transmission density of at 1 least about 5.0 and generally about 6.0 or 7.0 or somewhat higher.

The pH-sensitive, polymeric optical filter agents of the invention can be utilized in an aqueous processing composition or layer of a film unit for provision of temporary opacification properties as previously described. In connection with such utilization, it may be advantageous to employ such optical filter agents in combination with other agents which provide desired opacification, such as other optical filter agents, or with other agents which promote the desired function of the optical filter agents of the invention. Thus, depending upon the solubility characteristics of the particular pH-sensitive optical filter agent of the invention utilized for the provision of desired opacification, solvent materials for such optical filter agents may advantageously be utilized to increase solubility of the polymeric optical filter agent in a processing composition or facilitate coating or other formation of a suitable layer so as to thereby provide improved functionality of the pH-sensitive polymeric optical filter agent of the invention. Solvent materials such as dimethyl sulfoxide and dimethyl formamide can, for example, be utilized as solvents or solubilizing agents for optical filter agents of the invention for the provision of more efficient utilization of the optical filter agent. Other solvents can similarly be utilized for this purpose.

Figure 2:
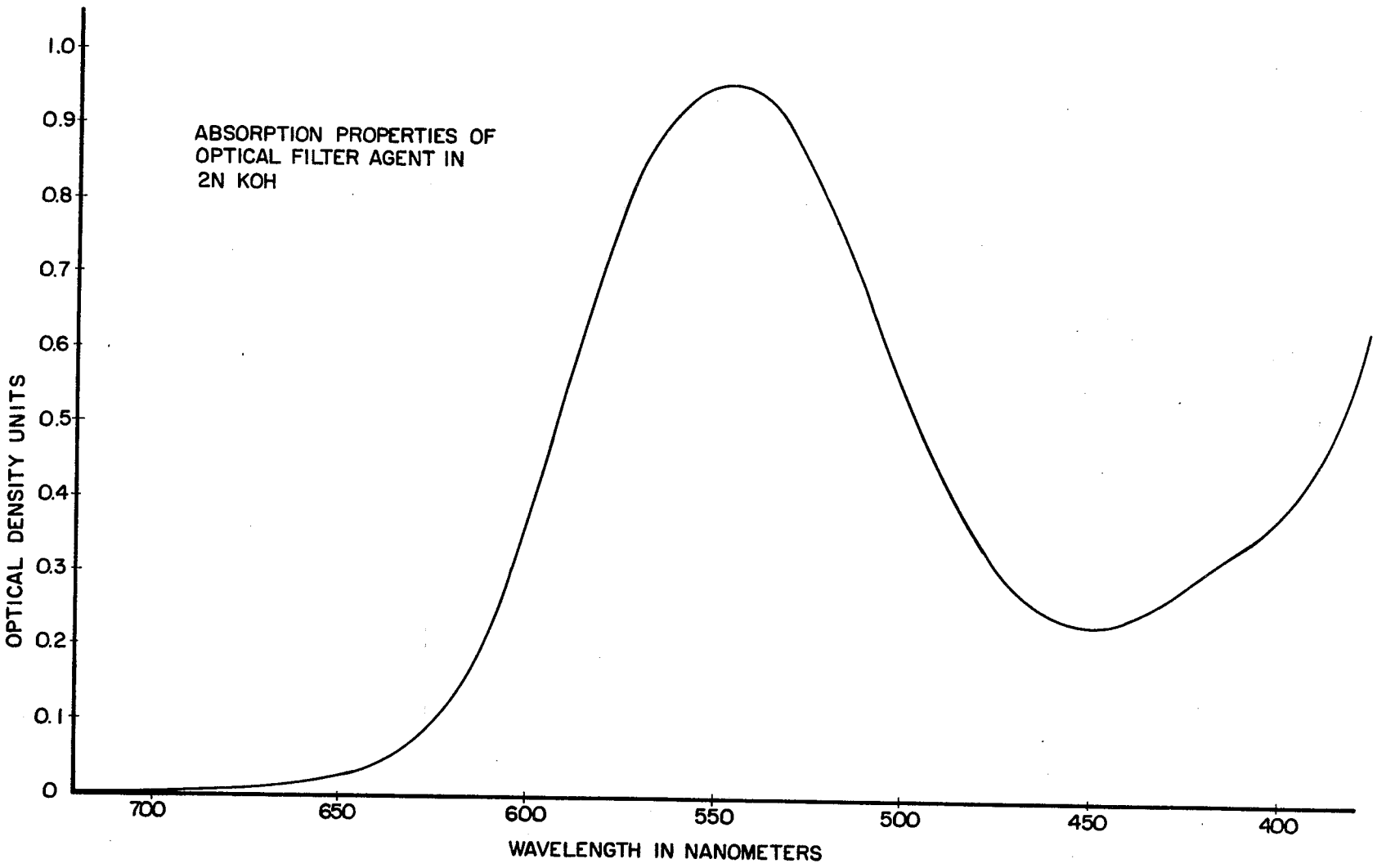
FIGS. 2 and 3 present graphic illustrations of spectral absorption characteristics of a polymeric, pH-sensitive, optical filter agent of this invention.
Figure 3:
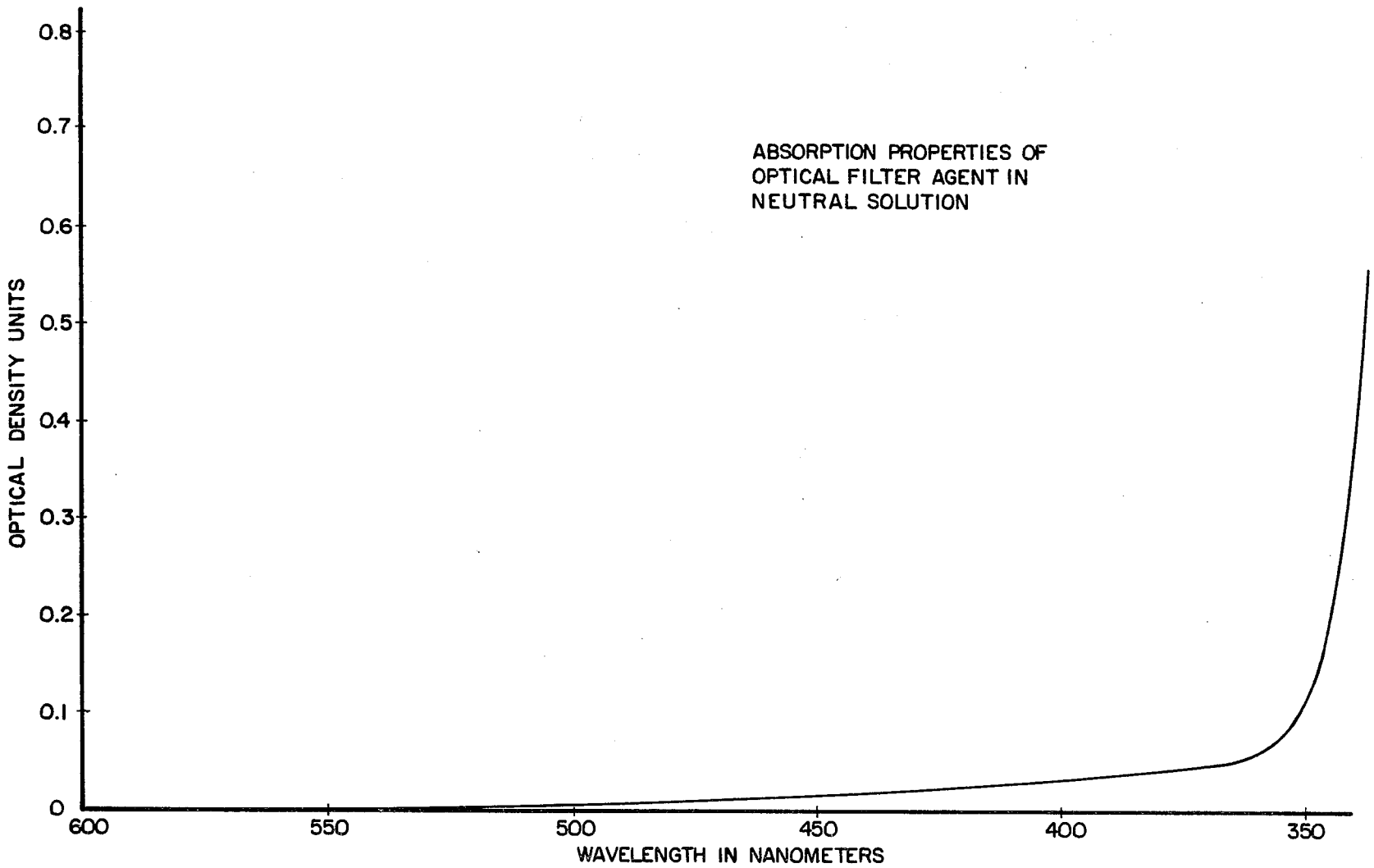

The pH-sensitive, polymeric, optical filter agents of this invention absorb radiation in the visible region of the spectrum. For example, the optical filter agents of the invention have been found to provide absorption for radiation in the green region (from about 500 nm to about 560 nm) of the visible spectrum. Some also provide absorption for radiation in the blue region as well (from about 450 nm to about 475 nm); others provide absorption for radiation in the green, blue, and also the red region (from about 640 nm to about 760 nm) of the visible spectrum. FIGS. 2 and 3 graphically illustrate absorption characteristics of a representative polymeric optical filter agent of this invention (the optical filter agent of Example 14 hereof). The Figures show the absorption densities of each optical filter agent measured over the wavelength range of 350 nm to 760 nm in an alkaline solution at a pH above the pKa of the optical filter agent (FIG. 2) and at a neutral pH (FIG. 3). As shown in the Figures, and described in greater detail hereinafter in connection with Example 14, the polymeric optical filter agent of this invention provids, at a pH above the pKa of the filter agent, an absorption capability for radiation in the visible region of the spectrum, and at neutral pH, virtually no such absorption.

In view of the possibly different absorption characteristics of individual polymeric optical filter agents, the selection of a particular polymeric optical filter agent of this invention will depend primarily on the spectral sensitivity of the silver halide emulsion layers of the film unit involved. For example, depending on the spectral sensitivity of the silver halide layers and the light conditions to which a film unit may be subjected during development, one or more polymeric optical filter agents of this invention may be utilized to protect the film unit from post-photoexposure fogging. Alternatively, selected polymeric optical filter agents may be used in combination with other known optical filter agents to provide the requisite protective absorption.

Details relating to manners of making the polymeric optical filter agents of this invention and to methods for using them will be better appreciated by reference to the following examples.

EXAMPLE 1

This Example illustrates the preparation of a partial oxime of poly(diacetone acrylamide) which is thereafter reacted with a hydrazine compound to provide a preferred polymeric optical filter agent of this invention.

The preparation involves the following reaction scheme:

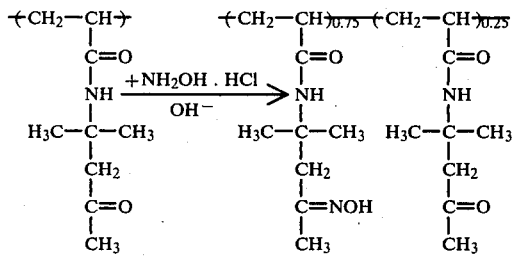

Polydiacetone acrylamide — Partial oxime of poly(diacetone acrylamide)

This preparation of the partial oxime involved the following materials:

| MATERIAL | MOL. WT. | MOLES | WT. (grams) |
|---|---|---|---|
| Poly(diacetone acrylamide) | 169 | 0.2 | 33.8 |
| Hydroxylamine Hydrochloride | 69.5 | 0.15 | 10.4 |
| KOH (45% by weight of aqueous solution) | 56 | 0.3 | 37.3 |
| Ethanol | | | 200 mls. |

The poly(diacetone acrylamide), 33.8 grams, was dissolved in 200 milliliters of ethanol by stirring over a steam bath. Thereafter, the hydroxylamine hydrochloride (10.4 g.) was added and the resulting mixture was heated until all solids had dissolved. The aqueous solution of potassium hydroxide (0.3 mole KOH) was added dropwise with stirring and a white precipitate was observed to appear. The reaction mixture was allowed to stand for approximately one hour after completion of the potassium hydroxide addition. The polymer was recovered by precipitation into one liter of water. The recovered polymer was heated to coagulate the polymer, washed with water, homogenized and filtered. The recovered partial oxime of polydiacetone acrylamide (having a 0.75 molar proportion of recurring oximated units) was utilized in the production of the hydrazone derivative set forth in following Example 2.

EXAMPLE 2

This Example illustrates the preparation of a polymeric optical filter agent of the present invention. The preparation involves the following reaction scheme.

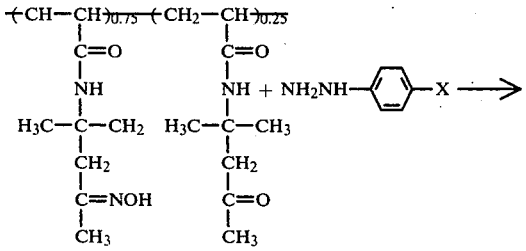

-continued

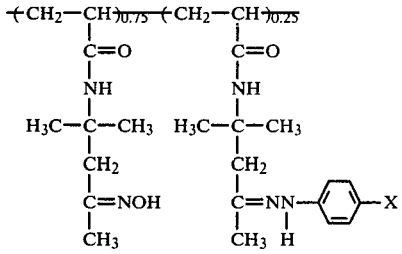

In this specific preparation,

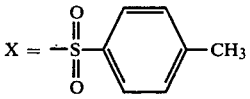

9.0 g. (0.05 mole) of the partial oxime of poly (diacetone acrylamide) of Example 1 were dissolved in 150 mls of ethanol by stirring the ingredients on a steam bath. 6.6 g. (0.025 mole) of p(4-tolylsulfonyl)phenyl hydrazine were then added to the partial oxime solution and the solution became a clear yellow. Three drops of acetic acid were added and the mixture was stirred on a steam bath for two hours and then stirred at room temperature overnight. The mixture containing a light yellow precipitate was suspended in 1.5 liters of water and heated on a steam bath. The solid partial oxime/hydrazone derivative was filtered off, resuspended in water, homogenized, filtered again, washed with about two liters of water and dried in a Buchner funnel.

EXAMPLE 3

The following Example illustrates the use of a pH-sensitive, polymeric optical filter agent of this invention in a film unit of the type disclosed in U.S. Pat. No. 3,415,644.

A film unit (comprising a photosensitive element, an image-receiving element and means for uniformly distributing an aqueous alkaline processing composition therebetween after photoexposure of the photosensitive element) was prepared as follows. A photosensitive element comprising an opaque polyethylene terephthalate film base containing the following layers, in sequence, was utilized:

1. A layer of cyan dye developer;
2. A red-sensitive gelatino-silver iodobromide emulsion;
3. A spacer layer;
4. A layer of magenta dye developer;
5. A green-sensitive gelatino silver iodobromide emulsion;
6. A spacer layer;
7. A layer of yellow dye developer;
8. A blue-sensitive gelatino-silver iodobromide emulsion; and
9. A gelatin overlayer.

As an image-receiving element there was employed a transparent polyethylene terephthalate film base carrying the following layers in sequence:

(1) a polymeric acid neutralizing layer;
(2) a polymeric spacer or timing layer; and
(3) a polymeric image-receiving layer or dyeable stratum.

Following photoexposure of the aforesaid photosensitive element to provide a developable image, the photo-exposed element and the aforesaid image-receiving element were superposed in face-to-face relation with their respective supports outermost. A rupturable container retaining an alkaline processing composition was fixedly mounted between the respective superposed elements at the leading edge to provide a film unit. The rupturable container, comprised of an outer layer of lead foil and an inner layer of polyvinylchloride, was provided with a marginal seal of predetermined weakness such that passage of the leading edge of the film unit into and through a pair of pressure rollers would effect a rupture of such seal and uniform distribution of the aqueous processing composition between the elements of the film unit. The rupturable container positioned between the elements of the film unit retained an aqueous alkaline processing composition having the following composition:

| Components | Weight(grams) |
|---|---|
| Polymeric optical filter agents of Example 2 | 1.0 |
| Potassium hydroxide solution (8% by wt. conc.) | 20 ml. |
| Titanium Dioxide | 8.4 |
| Viscosity-increasing agent-oxime of poly(diacetone acrylamide) | 0.12 |
| N-phenethyl α-picolinium bromide | 0.4 |
| 3,5-dimethyl pyrazole | 0.05 |

For purposes of evaluating the opacification capability of the pH-sensitive optical filter agents of the present invention, comparable film units as aforedescribed were developed, respectively in the dark and under conditions of ambient light and the $D_{min}$ and $D_{max}$ values of the respective images were examined for detection of decrease in such values in the case of in-light processing as compared to such values in the case of processing in the dark. In one case, the film unit (Film Unit A) was passed in the dark through a pair of rollers having a 0.0016 inch mechanical gap and allowed to remain in the dark for 30 seconds at which time the film unit was subjected to ambient room light. In a second case, the film unit (Film Unit B) was passed in the dark through the same rollers but immediately thereafter subjected to ambient room light. The following results were obtained:

| | $D_{min}$ | | | $D_{max}$ | | |
|---|---|---|---|---|---|---|
| | R | G | B | R | G | B |
| Film Unit A (30" dark/room light) | 0.21 | 0.28 | 0.38 | 0.98 | 0.68 | 0.69 |
| Film Unit B (room light) | 0.24 | 0.30 | 0.39 | 0.91 | 0.69 | 0.69 |

From inspection of the results set forth above, it will be seen that comparable sensitometric results were obtained. Film Unit B, subjected to ambient light for 30 seconds longer than Film Unit A, exhibited no decrease in density indicating that the opacification provided in Film Unit B was comparable to the darkness condition in the case of Film Unit A.

A control film unit, utilizing a processing composition as above-described but having not optical filter agent present, was processed through the mechanical rollers at a 0.0016 inch gap and into ambient light. The result was that the photosensitive element was badly fogged.

EXAMPLE 4

Part A. Preparation of Partial Oxime of Poly(diacetone acrylamide)

A partial oxime of poly(diacetone acrylamide) was prepared using the procedure and according to the reaction scheme set forth in Example 1 hereinbefore. The recovered polymeric material was utilized in the reaction set forth in Part B hereof.

PART B. Preparation of 4-(Methylsulfonyl)phenyl Hydrazone Derivative

The 4-(methylsulfonyl)phenyl hydrazone derivative of the partial oxime of poly(diacetone acrylamide) of Part A hereof was prepared utilizing the procedure and reaction scheme described in Example 2 hereof except that the following reactants and proportions were employed:

| | Mol.Wt. | Moles | WT. (grams) |
|---|---|---|---|
| Partial Oxime of poly(diacetone acrylamide) from Part A | 180 | 0.05 | 9.0 |
| 4-(methylsulfonyl)phenyl hydrazine | 186.2 | 0.025 | 4.7 |
| Ethanol | | | 200 ml |

The hydrazone derivative of the partial oxime of poly(diacetone acrylamide) prepared herein had the following structure:

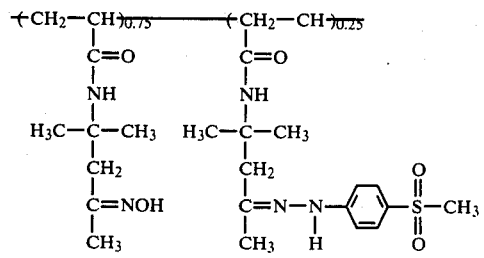

EXAMPLE 5

Film units as described in Example 3 hereof were prepared, processed and evaluated in the manner described in Example 3, except that the aqueous alkaline processing composition of the film units of this Example comprised the pH-sensitive polymeric optical filter agent described in Part B of Example 4 and had the following composition:

| Components | Weight(grams) |
|---|---|
| Polymeric optical filter agent of Example 4 (Part B) | 2.0 |
| Potassium hydroxide solution (10% by wt.conc.) | 20 ml. |
| Titanium Dioxide | 12.0 |
| Viscosity-increasing agent - Oxime of poly(diacetone acrylamide) | 0.14 |
| N-phenethyl α-picolinium bromide | 0.44 |
| 3,5-dimethyl pyrazole | 0.06 |

The film units hereof were evaluated in the manner described in Example 3. In one case, the film unit (Film Unit C) was passed in the dark through a pair of rollers having a 0.0016 inch mechanical gap and allowed to remain in the dark for 30 seconds at which time the film unit was subjected to ambient room light. In a second case, the film unit (Film Unit D) was passed in the dark through the same rollers but immediately thereafter subjected to ambient room light. The following results were obtained:

| | $D_{min}$ | | | $D_{max}$ | | |
|---|---|---|---|---|---|---|
| | R | G | B | R | G | B |
| Film Unit C (30" dark/room light) | 0.24 | 0.33 | 0.44 | 0.64 | 0.65 | 0.72 |
| Film Unit D (room light) | 0.21 | 0.30 | 0.42 | 0.45 | 0.50 | 0.63 |

EXAMPLE 6

PART A. Preparation of Partial Oxime of Poly(diacetone acrylamide)

A partial oxime of poly(diacetone acrylamide) was prepared using the procedure and according to the reaction scheme set forth in Example 1, except that the following materials and proportions were utilized:

| MATERIAL | MOL. WT. | MOLES | WT. (GRAMS) |
|---|---|---|---|
| Poly(diacetone acrylamide) | 169 | 0.1 | 16.9 |
| Hydroxylamine Hydrochloride | 69.5 | 0.02 | 1.39 |
| KOH(45% by weight of aqueous solution) | 56 | 0.4 | 4.98 ml. |
| Ethanol | | | 200 ml. |

The resulting partial oxime of poly(diacetone acrylamide) had the recurring units and proportions set forth as follows:

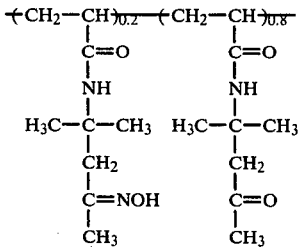

PART B. Preparation of p-Nitrophenyl Hydrazone Derivative

The p-nitrophenyl hydrazone derivative of a partial oxime of poly(diacetone acrylamide) was obtained by reaction of a partial oxime of poly(diacetone acrylamide) with p-nitrophenyl hydrazine. The polymer (5.2 gms. of the polymer prepared as described in Example 6-Part A) was dissolved in 50 mls. of ethanol and 4.6 gms. of the p-nitrophenyl hydrazine was added. The solution became intensely yellow and the reaction mixture was stirred for about two hours. The polymeric hydrazone derivative was precipitated into water, homogenized, washed with water, filtered and dried overnight in a vacuum oven. The resulting product, 4.5 gms. of a yellow solid, had the following structure:

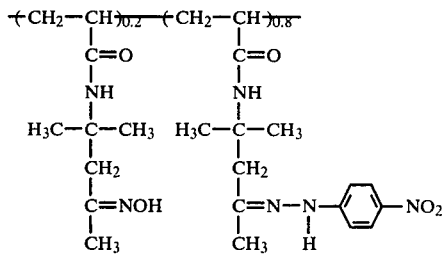

EXAMPLE 7

The p-nitrophenyl hydrazone derivative of a partially oximated (80%) poly(diacetone acrylamide) was obtained utilizing the procedure of Example 6-Part B except that the following ingredients were utilized:

| | MOL. WT. | MOLES | WT. (GRAMS) |
|---|---|---|---|
| poly(diacetone acrylamide) oxime (80% oximation) | 180 | 0.03 | 5.4 |
| p-nitrophenyl hydrazine | 189.6 | 0.006 | 1.14 |
| Ethanol | | | 100 ml. |

The resulting hydrazone derivative, a yellow solid, had the following structure.

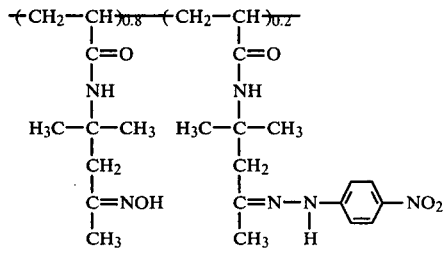

EXAMPLE 8

PART A: Preparation of Partial Oxime of Poly(diacetone acrylamide)

A partial oxime of poly(diacetone acrylamide) was prepared using the procedure and according to the reaction scheme set forth in Example 1, except that the following materials and proportions were utilized:

| MATERIAL | MOL. WT. | MOLES | WT. (GRAMS) |
|---|---|---|---|
| Poly(diacetone acrylamide) | 169 | 0.1 | 16.9 |
| Hydroxylamine Hydrochloride | 69.5 | 0.05 | 3.48 |
| KOH(45% by weight of aqueous solution) | 56 | 0.1 | 12.44 |
| Ethanol | | | 200 ml. |

The resulting partial oxime of poly(diacetone acrylamide) had the recurring units and proportions set forth as follows:

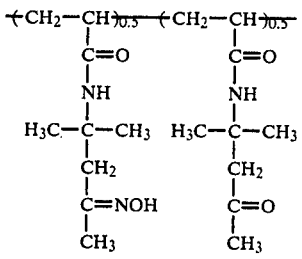

PART B: Preparation of 2,4-bis-dimethylsuflonylphenyl Hydrazone Derivative

The 2,4-bis-dimethylsuflonylphenyl hydrazone derivative of a partial oxime of poly(diacetone acrylamide) was obtained by dissolving 8.55 gms. (0.05 mole) of the polymer from Part A above in 100 ml. of ethanol with stirring. To the solution was added 6.61 gms. (0.025 mole) of 2,4-bis-dimethylsulfonylphenyl hydrazine. Two drops of glacial acetic acid were added and the yellowish reaction solution was stirred for one hour. The hydrazone derivative was precipitated out of the ethanolic solution and was washed three times with water, homogenized, filtered and dried in a vacuum oven overnight. The resulting polymeric product, about 10 gms. of off-white solid had the following structure:

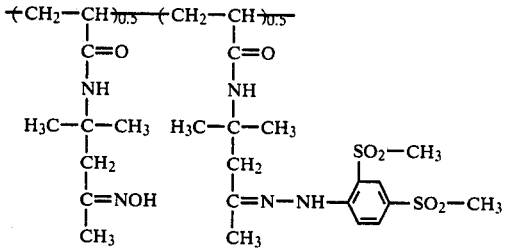

EXAMPLE 9

Preparation of p-difluoromethylsulfonylphenyl Hydrazone Derivative of a Partial Oxime of Poly(diacetone acrylamide)

The p-difluoromethylsulfonylphenyl hydrazone derivative of a partial oxime of poly(diacetone acrylamide) was obtained by dissolving 8.2 gms. (0.05 mole) of the polymer (prepared as described in Part A of Example 8) in 100 ml. of ethanol by heating on a steam bath. To the polymer solution were added 5.5 gms. (0.025 mole) of p-difluoromethylphenyl hydrazine with stirring. About 0.05 ml. of glacial acetic acid was added. The resulting solution was stirred for three hours. The polymeric hydrazone derivative was recovered by precipitation into water and was washed with water three times, homogenized, filtered and dried in a vacuum oven. The resulting polymer, about 10 gms. of yellowish solid, had the following structure:

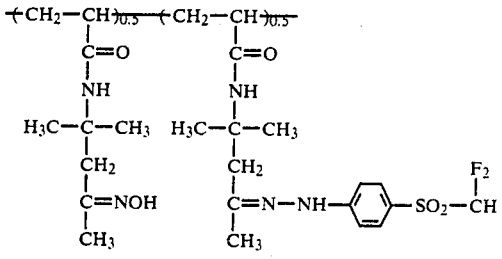

EXAMPLE 10

Preparation of the p-(methylsulfonyl)phenyl Hydrazone Derivative of Poly(diacetone acrylamide)

The p-(methyl sulfonyl)phenyl hydrazone derivative of poly(diacetone acrylamide) was obtained by dissolving 16.9 gms. (0.01 mole) of poly(diacetone acrylamide) in 300 ml. of ethanol to which was added 18.6 gms. (0.1 mole) of 4-(methyl sulfonyl)phenyl hydrazine. The solution was refluxed with stirring for about two hours. To the reaction mixture was added 12.4 gms. (0.1 mole) of potassium hydroxide. A dark-purple polymer was precipitated out of solution and the resulting product was dissolved in tetrahydrofuran and precipitated into water. The recovered polymer, about 20 gms. of a yellowish solid, had the following recurring units:

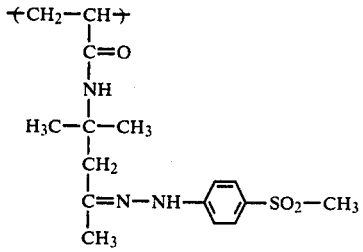

EXAMPLE 11

PART A: Preparation of Partial Oxime of Copolymer of Diacetone Acrylamide and Acrylic Acid The partial oxime of a copolymer of diacetone acrylamide and acrylic acid was prepared from a 90/10 molar proportion copolymer of diacetone acrylamide/acrylic acid prepared by emulsion polymerization and having a latex solids content of 20.2% by weight. The latex (118.3 gms.) was diluted with water to about 2.5 to 3% solids by weight. A solution containing 10.95 gms. of a 45%-by-weight solution of potassium hydroxide, 50 ml. of water and 5.56 gms. of hydroxylamine hydrochloride was added in a dropwise manner at room temperature and with stirring. To the reaction mixture was added 10.83 gms. of a 45%-by-weight solution of potassium hydroxide for neutralization of acrylic acid. The reaction mixture was stirred from 3 to 4 hours and 16.67 gms. of hydrochloric acid (37.8 wt.% conc.) were added to neutralize the potassium hydroxide to pH 4. The resulting latex polymer was washed with water and recovered for subsequent hydrazone derivatization. The polymer had the following structure:

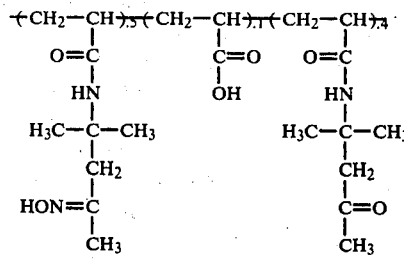

PART B: Preparation of 4-(Methylsulfonyl)phenyl Hydrazone Derivative of Partial Oxime of Copolymer of Diacetone Acrylamide and Acrylic Acid The 4-(methylsulfonyl)phenyl hydrazone derivative of the copolymer of Part A above was prepared utilizing the procedure set forth in Example 2 except that the following reactants were utilized:

| | MOL. WT. | MOLES | WEIGHT (GMS.) |
|---|---|---|---|
| Partial Oxime of Copolymer of Diacetone Acrylamide and Acrylic Acid (Part A) | 166.8 | 0.05 | 8.34 |
| 4-(methylsulfonyl)phenyl hydrazine | 186.2 | 0.025 | 4.65 |
| Ethanol | | | 250 ml. |

The recovered polymer, about 12 gms. of an off-white solid, had the following structure:

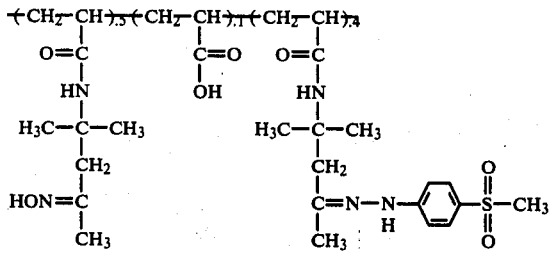

EXAMPLE 12

PART A. Preparation of Partial Oxime of Poly(diacetone acrylamide)

A partial oxime of poly(diacetone acrylamide) was prepared using the procedure and according to the reaction scheme set forth in Example 1, except that the following materials and proportions were utilized:

| MATERIAL | MOL. WT. | MOLES | WT. (GRAMS) |
|---|---|---|---|
| Poly(diacetone acrylamide) | 169 | 0.1 | 16.9 |
| Hydroxylamine Hydrochloride | 69.5 | 0.07 | 4.87 |
| KOH(45% by weight of aqueous solution) | 56 | 0.07 | 8.71 ml. |
| Ethanol | | | 200 ml. |

The resulting partial oxime of poly(diacetone acrylamide had the recurring units and proportions set forth as follows:

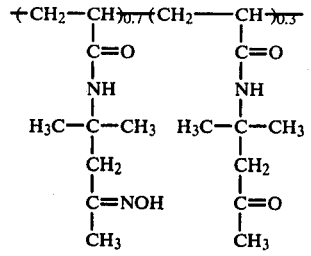

PART B. Preparation of p-Nitrophenyl Hydrazone Derivative

The p-nitrophenyl hydrazone derivative of a partial oxime of poly(diacetone acrylamide) was obtained by reaction of a partial oxime of poly(diacetone acrylamide) with p-nitrophenyl hydrazine. The polymer (8.2 gms. of the polymer prepared as described in Example 12-Part A) was dissolved in 150 mls. of ethanol and 5.7 gms. of the p-nitrophenyl hydrazine was added. The solution became intensely yellow and the reaction mixture was stirred for about two hours. The polymeric hydrazone derivative was precipitated into water, homogenized, washed with water, filtered and dried overnight in a vacuum oven. The resulting product, a yellow solid, had the following structure:

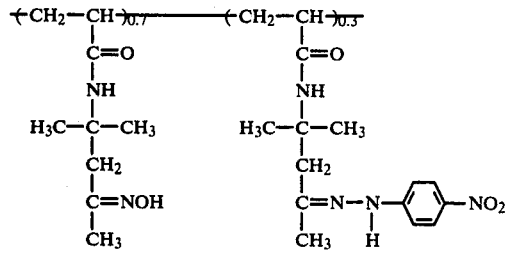

EXAMPLE 13

Film units as described in Example 3 hereof were prepared, processed and evaluated in the manner described in Example 3, except that the aqueous alkaline processing composition of the film units of this Example comprised the pH-sensitive polymeric optical filter agent described in Part B of Example 12 and had the following composition:

| Components | Weight (grams) |
|---|---|
| Polymeric optical filter agent of Example 12 (Part B) | 2.5 |
| Potassium hydroxide (pellets) | 2.5 |
| Titanium Dioxide | 17.0 |
| N-phenethyl α-picolinium bromide | 0.65 |
| 3,5-dimethyl pyrazole | 0.08 |
| Water | 28.0 |

The film units hereof were evaluated in the manner described in Example 3. In one case, the film unit (Film Unit E) was passed in the dark through a pair of rollers having a 0.0016 inch mechanical gap and allowed to remain in the dark for 30 seconds at which time the film unit was subjected to ambient room light. In a second case, the film unit (Film Unit F) was passed in the dark through the same rollers but immediately thereafter subjected to ambient room light. The following results were obtained:

| | $D_{Min}$ | | | $D_{Max}$ | | |
|---|---|---|---|---|---|---|
| | R | G | B | R | G | B |
| Film Unit E (30" dark/room light) | 0.24 | 0.33 | 0.59 | 1.25 | 1.05 | 1.28 |
| Film Unit F (room light) | 0.25 | 0.34 | 0.56 | 0.49 | 0.85 | 1.13 |

A control film unit, utilizing a processing composition as above-described but having no optical filter agent present, was processed through the mechanical rollers at a 0.0016 inch gap and into ambient light. The result was that the photosensitive element was badly fogged. The following results were obtained:

| | $D_{Min}$ | | | $D_{Max}$ | | |
|---|---|---|---|---|---|---|
| | R | G | B | R | G | B |
| Control Film Unit | 0.18 | 0.27 | 0.37 | 0.18 | 0.26 | 0.43 |

EXAMPLE 14

PART A. Preparation of Partial Oxime of Poly(diacetone acrylamide)

A partial oxime of poly(diacetone acrylamide) was prepared using the procedure and according to the reaction scheme set forth in Example 12 hereinbefore. The recovered polymeric material was utilized in the reaction set forth in Part B hereof.

PART B. Preparation of 4-(Methylsulfonyl)phenyl Hydrazone Derivative

The 4-(methylsulfonyl)phenyl hydrazone derivative of the partial oxime of poly(diacetone acrylamide) of Part A hereof was prepared utilizing the procedure and reaction scheme described in Example 2 hereof except that the following reactants and proportions were employed:

| | Mol.Wt. | Moles | Wt.(grams) |
|---|---|---|---|
| Partial Oxime of poly(diacetone acrylamide) from Part A | 171 | 0.05 | 8.2 |
| 4-(methylsulfonyl)phenyl hydrazine | 186.2 | 0.3 | 5.6 |
| Ethanol | | | 100 ml. |

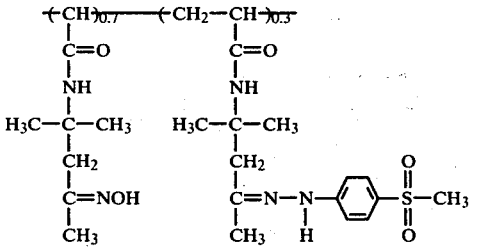

The recovered hydrazone product was further purified by washing the product with ethanol and water. Infrared analysis confirmed the absence of carbonyl groups, indicative of conversion to hydrazone groups. In FIG. 2 is shown the absorption characteristics of the compound of Example 14 at a $10^{-4}$ Molar concentration in a 90:10, by weight, mixture of 2 Normal potassium hydroxide and tetrahydrofuran. As can be seen from FIG. 2, the presence of the compound of Example 14 in an alkaline medium above the pKa of the compound exhibits absorption characteristics within the visible region of the electromagnetic spectrum. The absorption characteristics represented by FIG. 2 are illustrative of the "turned-on" or light-absorbing characteristic of an optical filter agent of the invention. From FIG. 3 can be seen the non-light absorbing or "turned-off" characteristics of an optical filter agent of the invention, the optical filter agent of Example 14. Thus, there is shown in FIG. 3, the absorption characteristics of the compound of Example 14 under the neutral pH condition of a $10^{-4}$ Molar concentration of the compound in tetrahydrofuran solvent. As is apparent from the absorption characteristics represented in FIG. 3, the compound of Example 14 showed virtually no absorption under the aforesaid conditions.

EXAMPLE 15

Film units as described in Example 3 hereof was prepared, processed and evaluated in the manner described in Example 3, except that the aqueous alkaline processing composition of the film units of this Example comprised the pH-sensitive polymeric optical filter agent described in Part B of Example 14 and had the following composition:

| Components | Weight (Grams) |
|---|---|
| Polymeric optical filter agent of Example 14 (Part B) | 2.5 |
| Potassium hydroxide (pellets) | 2.5 |
| Titanium Dioxide | 12.0 |
| N-phenethyl α-picolinium bromide | 0.44 |
| 3,5-dimethyl pyrazole | 0.06 |
| Water | 28.0 |

The film units hereof were evaluated in the manner described in Example 3. In one case, the film unit (Film Unit G) was passed in the dark through a pair of rollers having a 0.0016 inch mechanical gap and allowed to remain in the dark for 30 seconds at which time the film unit was subjected to ambient room light. In a second case, the film unit (Film Unit H) was passed in the dark through the same rollers but immediately thereafter subjected to ambient room light. The following results were obtained:

| | $D_{min}$ | | | $D_{max}$ | | |
|---|---|---|---|---|---|---|
| | R | G | B | R | G | B |
| Film Unit G (30" dark/room light) | 0.23 | 0.30 | 0.37 | 1.64 | 1.41 | 1.58 |
| Film Unit H (room light) | 0.24 | 0.32 | 0.40 | 1.63 | 1.20 | 1.04 |

What is claimed is:

1. A photographic film unit which comprises a photosensitive element comprising at least one photosensitive silver halide emulsion layer and having associated therewith a polymeric optical filter agent having a light-absorbing capability at a pH above the pKa of the optical filter agent, said polymeric optical filter agent having attached directly or indirectly to the backbone thereof the following hydrazone moiety:

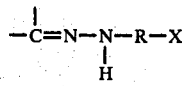

where R is a group which provides a carbon-to-carbon double bond for conjugation with the

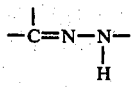

portion of the moiety to provide said light-absorbing capability for the moiety at a pH above the pKa of the moiety and X represents a substituent of R providing at least one electron-withdrawing group.

2. The photographic film unit of claim 1 wherein R of said polymeric optical filter agent conforms to one of the following structural formulae:

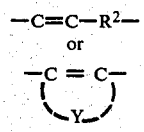

where $R^2$ represents a divalent hydrocarbon moiety or a divalent moiety comprising a carbocyclic or heterocyclic ring structure and Y represents the atoms necessary to complete a carbocyclic ring structure, a heterocyclic ring structure or a fused polycyclic ring structure.

3. The photographic film unit of claim 1 wherein said polymeric optical filter agent comprises recurring units of the formula:

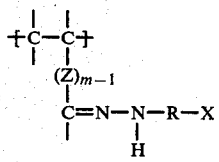

where Z is a divalent radical and m is an integer 1 or 2.

4. The photographic film unit of claim 3 wherein said R group is

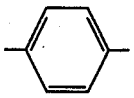

and said electron-withdrawing X group is halogen, halogen-substituted alkyl, nitro or

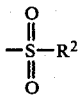

where $R^2$ is alkyl, aryl, substituted-alkyl or substituted aryl.

5. The photographic film unit of claim 1 wherein said polymeric optical filter agent conforms to the structure:

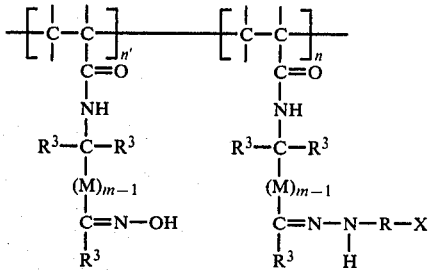

where each $R^3$ is alkyl of from 1 to 6 carbon atoms, M is an alkylene radical having from 1 to 6 carbon atoms, m is an integer 1 or 2 and each of n and n' represents the molar proportion of the respective recurring unit of the polymer backbone.

6. The photographic film unit of claim 5 wherein said R group is

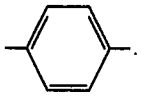

7. The photographic film unit of claim 6 wherein n of said polymeric optical filter agent is from about 5 to about 80 mole percent and n' is from about 20 to about 95 mole percent.

8. The photographic film unit of claim 1 wherein said polymeric optical filter agent is contained in a layer permeable to aqueous processing composition, said polymeric optical filter agent being disposed in said layer at a pH below the pKa of the polymeric optical filter agent, said layer being positioned between said photosensitive element and a layer of said film unit through which said photosensitive element is exposed.

9. The photographic film unit of claim 8 wherein there is included means for reducing the environmental pH of said film unit after exposure of said photosensitive element and application of an aqueous alkaline processing composition from a pH above the pKa of said polymeric optical filter agent to a predetermined pH below the pKa of said polymeric optical filter agent.

10. The photographic film unit of claim 1 wherein there is included means for distributing an aqueous alkaline processing composition on said photosensitive element and wherein said polymeric optical filter agent is contained in said aqueous alkaline processing composition.

11. The photographic film unit of claim 9 wherein said polymeric optical filter agent is disposed in said aqueous alkaline processing composition at a pH above the pKa of said polymeric optical filter agent.

12. A photographic film unit for forming a diffusion transfer image which comprise in combination:

a photosensitive element comprising an opaque support carrying at least one photosensitive silver halide emulsion layer, each said silver halide emulsion layer having associated therewith a dye image-forming material; an image-receiving element comprising a transparent support carrying at least a polymeric image-receiving layer dyeable by said dye image-forming material, said image-receiving element being adapted to exposure therethrough of said photosensitive element and being in a superposed fixed relation to said photosensitive element with said supports outermost; a rupturable container releasably holding an aqueous alkaline processing composition, said rupturable container being positioned so as to release said processing composition for distribution between said dyeable polymeric layer and said photosensitive element adjacent thereto upon application of pressure to said container after photoexposure of said photosensitive element; and disposed in said film unit in said processing composition and/or in a layer intermediate said photosensitive element and said image-receiving element, a polymeric optical filter agent having a light-absorbing capability at a pH above the pKa of the optical filter agent effective to absorb at least a portion of actinic radiation within a predetermined range, said polymeric optical filter agent having attached directly or indirectly to the backbone thereof the following hydrazone moiety:

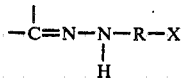

where R is a group which provides a carbon-to-carbon double bond for conjugation with the

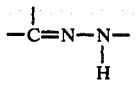

portion of the moiety to provide said light-absorbing capability for the moiety at a pH above the pKa of the moiety and X represents a substituent of R providing at least one electron-withdrawing group.

13. The photographic film unit of claim 13 wherein R of said polymeric optical filter agent conforms to one of the following structural formulae:

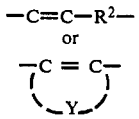

where $R^2$ represents a divalent hydrocarbon moiety or a divalent moiety comprising a carbocyclic or heterocyclic ring structure and Y represents the atoms necessary to complete a carbocyclic ring structure, a heterocyclic ring structure or a fused polycyclic ring structure.

14. The photographic film unit of claim 12 wherein said polymeric optical filter agent comprises recurring units of the formula

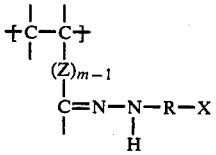

where Z is a divalent radical and m is an integer 1 or 2.

15. The photographic film unit of claim 14 wherein said R group is

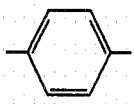

and said electron-withdrawing X group is halogen, halogen-substituted alkyl, nitro or

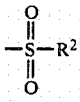

where $R^2$ is alkyl, aryl, substituted-alkyl or substituted aryl.

16. The photographic film unit of claim 12 wherein said polymeric optical filter agent conforms to the structure

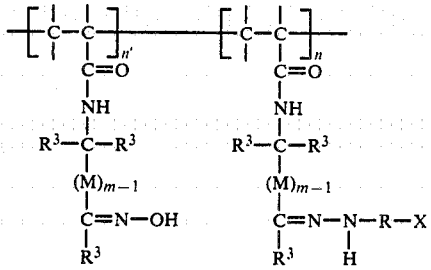

where each $R^3$ is alkyl of from 1 to 6 carbon atoms, M is an alkylene radical having from 1 to 6 carbon atoms, m is an integer 1 or 2 and each of n and n' represents the molar proportion of the respective recurring unit of the polymer backbone.

17. The photographic film unit of claim 16 wherein said R group is

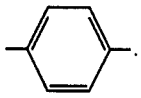

18. The photographic film unit of claim 17 wherein n of said polymeric optical filter agent is from about 5 to about 80 mole percent and n' is from about 20 to about 95 mole percent.

19. The photographic film unit of claim 12 wherein said polymeric optical filter agent is contained in a layer permeable to aqueous processing composition, said polymeric optical filter agent being disposed in said layer at a pH below the pKa of the polymeric optical filter agent, said layer being positioned intermediate said photosensitive element and said image-receiving element through which said photosensitive material is photoexposed.

20. The photographic film unit of claim 19 wherein there is included means for reducing the environmental pH of said film unit after photoexposure of said photosensitive element and application of an aqueous alkaline processing composition from a pH above the pKa of said polymeric optical filter agent to a predetermined pH below the pKa of said polymeric optical filter agent.

21. The photographic film unit of claim 12 wherein said polymeric optical filter agent is contained in said aqueous alkaline processing composition.

22. The photographic film unit of claim 21 wherein said polymeric optical filter agent is disposed in said aqueous alkaline processing composition at a pH above the pKa of said polymeric optical filter agent.

23. A film unit as defined in claim 12 wherein said aqueous alkaline processing composition includes a reflecting agent effective upon distribution between said photosensitive and image-receiving elements to provide a background for the viewing of said transfer image in said image-receiving layer.

24. A film unit as defined in claim 23 wherein said reflecting agent taken together with said polymeric optical filter agent are adapted to prevent further exposure of the selectively photoexposed silver halide layer during processing in the presence of radiation within said predetermined wavelength range actinic to the photosensitive element and incident thereto from the side of the film unit opposed to said opaque support.

25. The photographic film unit of claim 12 wherein said image-forming material comprises a dye which is a silver halide developing agent.

26. The photographic film unit of claim 25 wherein said photosensitive element includes at least two selectively sensitized silver halide emulsion layers, each having associated therewith a dye which is a silver halide developing agent of predetermined color, each of said dyes being soluble and diffusible in alkaline processing composition as a function of the point-to-point degree of exposure of the respective emulsion associated therewith at said first pH and substantially nondiffusible in said alkaline processing composition at said second pH.

27. The photographic film unit of claim 26 wherein said photosensitive element includes, as essential layers, in sequence, from said opaque layer, an alkaline solution permeable polymeric layer containing a cyan dye; a red-sensitive silver halide emulsion layer; an alkaline solution permeable polymeric layer containing a magenta dye; a green-sensitive silver halide emulsion layer; an alkaline solution permeable polymeric layer containing a yellow dye; a blue-sensitive silver halide emulsion layer, each of said cyan, magenta and yellow dyes being silver halide developing agents and being soluble and diffusible, in aqueous alkaline solution at said first pH and substantially insoluble in aqueous alkaline solution at said second pH.

28. A photographic process comprising the steps of photoexposing a photosensitive element comprising at least one photosensitive silver halide emulsion layer to radiation actinic thereto to provide a latent image therein, applying a processing composition to provide an optical filter agent in a form capable of absorbing actinic radiation within a predetermined wavelength range, and developing said latent image with said processing composition, said optical filter agent being present during development in a position and quantity effective to absorb at least a portion of incident actinic radiation within said predetermined range, said optical filter agent being a polymeric optical filter agent having attached directly or indirectly to the backbone thereof the following hydrazone moiety:

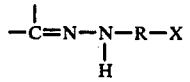

where R is a group which provides a carbon-to-carbon double bond for conjugation with the

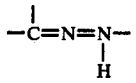

portion of the moiety to provide said radiation absorbing capability for the moiety at a pH above the pKa of the moiety and X represents a substituent of R providing at least one electron-withdrawing group.

29. The photographic process of claim 28 wherein R of said polymeric optical filter agent conforms to one of the following structural formulae:

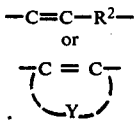

where $R^2$ represents a divalent hydrocarbon moiety or a divalent moiety comprising a carbocyclic or heterocyclic ring structure and Y represents the atoms necessary to complete a carbocyclic ring structure, a heterocyclic ring structure or a fused polycyclic ring structure.

30. The photographic process of claim 28 wherein said polymeric optical filter agent comprises recurring units of the formula:

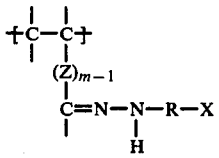

where Z is a divalent radical and m is an integer 1 or 2.

31. The photographic process of claim 30 wherein said R group is

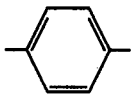

and said electron-withdrawing X group is halogen, halogen-substituted alkyl, nitro or

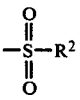

where $R^2$ is alkyl, aryl, substituted-alkyl or substituted aryl.

32. The photographic process of claim 28 wherein said polymeric optical filter agent conforms to the structure:

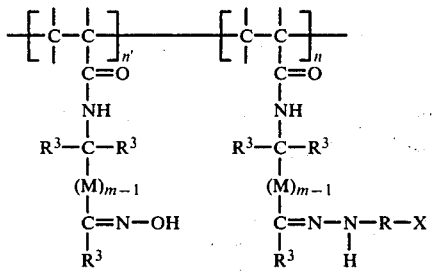

where each $R^3$ is alkyl of from 1 to 6 carbon atoms, M is an alkylene radical having from 1 to 6 carbon atoms, m is an integer 1 or 2 and each of n and n' represents the molar proportion of the respective recurring unit of the polymer backbone.

33. The photographic process of claim 32 wherein said R group is

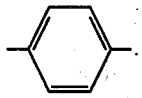

34. The photographic process of claim 33 wherein n of said polymeric optical filter agent is from about 5 to about 80 mole percent and n' is from about 20 to about 95 mole percent.

35. The photographic process of claim 28 wherein said polymeric optical filter agent is contained in a layer permeable to aqueous processing composition, said polymeric optical filter agent contained in said layer being prior to said application of processing composition disposed at a pH below the pKa of the polymeric optical filter agent, said layer being positioned between said photosensitive element and a layer of said film unit through which said photosensitive element is exposed.

36. The photographic process of claim 35 wherein, subsequent to said application of said processing composition, said polymeric optical filter agent is present at a pH above the pKa of said polymeric optical filter agent and in said form capable of absorbing actinic radiation within said predetermined wavelength range and wherein, upon substantial completion of development of said photoexposed element, the environmental pH of said process is reduced to a pH below the pKa of said polymeric optical filter agent.

37. The photographic process of claim 28 wherein said polymeric optical filter agent in said form capable of absorbing actinic radiation within a predetermined wavelength range is provided by including said polymeric optical filter agent in said processing composition, said processing composition having a pH at which said polymeric optical filter agent is light-absorbing.

38. The photographic process of claim 37 wherein said processing composition containing said polymeric optical filter agent is separated from said photosensitive element upon substantial completion of development and image formation.

39. The photographic process of claim 37 wherein said polymeric optical filter agent is retained in said element and is rendered ineffective to prevent viewing of the final image subsequent to substantial image development by adjusting the pH of the element to a value at which said polymeric optical filter agent is substantially non-light-absorbing.

40. A photographic process for forming a diffusion transfer image which comprises, in combination, the steps of:

(a) photoexposing a photographic film unit which comprises a plurality of layers including an opaque support layer carrying a photosensitive silver halide layer having associated therewith a compound capable of providing as a function of development an imagewise distribution of an image-forming material which is processing composition soluble and diffusible as a function of the point-to-point degree of exposure of said silver halide layer and a diffusion transfer process image receiving layer adapted to receive solubilized image-forming material diffusing thereto;

(b) contacting said photosensitive silver halide layer with an aqueous alkaline processing composition to provide an optical filter agent in a form capable of absorbing a predetermined wavelength range of radiation actinic to said photosensitive material, said optical filter agent being a polymeric optical filter agent having attached directly or indirectly to the backbone thereof the following hydrazone moiety:

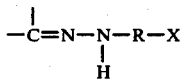

where R is a group which provides a carbon-to-carbon double bond for conjugation with the

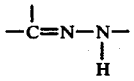

portion of the moiety to provide said radiation absorbing capability for the moiety at a pH above the pKa of the moiety, and X represents a substituent of R providing at least one electron-withdrawing group;

(c) effecting substantial development of said silver halide emulsion;

(d) forming an imagewise distribution of diffusible image-forming material, as a function of the point-to-point degree of emulsion exposure; and (e) transferring, by diffusion, at least a portion of said imagewise distribution of diffusible image-forming material to said layer adapted to receive said material to provide an image therein; said optical filter agent being present during development in a position and quantity effective to absorb at least a portion of incident actinic radiation within said predetermined range.

41. The photographic process of claim 40 wherein R of said polymeric optical filter agent conforms to one of the following structural formulae:

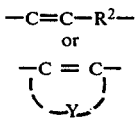

where $R^2$ represents a divalent hydrocarbon moiety or a divalent moiety comprising a carbocyclic or heterocyclic ring structure and Y represents the atoms necessary to complete a carbocyclic ring structure, a heterocyclic ring structure or a fused polycyclic ring structure.

42. The photographic process of claim 40 wherein said polymeric optical filter agent comprises recurring units of the formula:

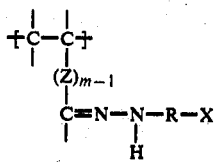

where Z is a divalent radical and m is an integer 1 or 2.

43. The photographic process of claim 42 wherein said R group is

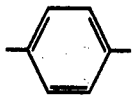

and said electron-withdrawing X group is halogen, halogen-substituted alkyl, nitro or

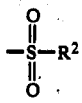

where $R^2$ is alkyl, aryl, substituted-alkyl or substituted aryl.

44. The photographic process of claim 40 wherein said polymeric optical filter agent conforms to the structure:

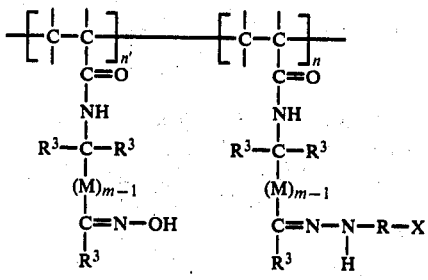

where each $R^3$ is alkyl of from 1 to 6 carbon atoms, M is an alkylene radical having from 1 to 6 carbon atoms, m is an integer 1 or 2 and each of n and n' represents the molar proportion of the respective recurring unit of the polymer backbone.

45. The photographic process of claim 44 wherein said R group is

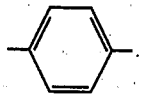

46. The photographic process of claim 45 wherein n of said polymeric optical filter agent is from about 5 to about 80 mole percent and n' is from about 20 to about 95 mole percent.

47. The photographic process of claim 40 wherein said polymeric optical filter agent is contained in a layer permeable to aqueous processing composition, said polymeric optical filter agent contained in said layer being prior to said application of processing composition disposed at a pH below the pKa of the polymeric optical filter agent, said layer being positioned between said photosensitive element and a layer of said film unit through which said photosensitive silver halide layer is exposed.

48. The photographic process of claim 47 wherein, subsequent to said application of said processing composition, said polymeric optical filter agent is present at a pH above the pKa of said polymeric optical filter agent and in said form capable of absorbing actinic radiation within said predetermined wavelength range and wherein, upon substantial completion of development of said photosexposed element, the environmental pH of said process is reduced to a pH below the pKa of said polymeric optical filter agent.

49. The photographic process of claim 40 wherein said polymeric optical filter agent in said form capable of absorbing actinic radiation within a predetermined wavelength range is provided by including said polymeric optical filter agent in said processing composition, said processing composition having a pH at which said polymeric optical filter agent is light-absorbing.

50. The photographic process of claim 49 wherein said processing composition containing said polymeric optical filter agent is separated from said photosensitive element upon substantial completion of development and image formation.

51. The photographic process of claim 49 wherein said polymeric optical filter agent is retained in said element and is rendered ineffective to prevent viewing of the final image subsequent to substantial image development by adjusting the pH of the element to a value at which said polymeric optical filter agent is substantially non-light-absorbing.

52. The photographic process of claim 49 wherein said polymeric optical filter agent is present during development in a position and amount effective to absorb said actinic radiation sufficiently to prevent substantial post-photo-exposure fogging of said photosensitive silver halide layer.

53. The photographic process of claim 28 wherein each said silver halide emulsion layer has associated therewith a dye image-forming material, said dye image-forming material comprising a dye which is a silver halide developing agent.

54. The photographic process of claim 53 wherein said photosensitive element includes at least two selectively sensitized silver halide emulsion layers, each having associated therewith a dye which is a silver halide developing agent of predetermined color, each of said dyes being soluble and diffusible in alkaline processing composition as a function of the point-to-point degree of exposure of the respective emulsion associated therewith at said first pH and substantially nondiffusible in said alkaline processing composition at said second pH.

55. The photographic process of claim 54 wherein said photosensitive element includes, as essential layers, in sequence, from said opaque layer, an alkaline solution permeable polymeric layer containing a cyan dye; a red-sensitive silver halide emulsion layer; an alkaline solution permeable polymeric layer containing a magenta dye; a green-sensitive silver halide emulsion layer; an alkaline solution permeable polymeric layer containing a yellow dye; a blue-sensitive silver halide emulsion layer, each of said cyan, magenta and yellow dyes being silver halide developing agents and being soluble and diffusible, in aqueous alkaline solution at said first pH and substantially insoluble in aqueous alkaline solution at said second pH.

56. A photographic product which comprises a photosensitive element comprising at least one photosensitive silver halide emulsion layer; said photographic product including a transparent, aqueous alkaline processing composition-permeable layer through which each silver halide emulsion layer of said photosensitive element is photo-exposable, said transparent layer containing a substantially non-light absorbing polymeric optical filter agent disposed in said transparent layer at a pH below the pKa of the optical filter agent, said optical filter agent being adapted upon contact with an aqueous alkaline processing composition to provide light-absorbing capability at a pH above the pKa of the optical filter agent, said substantially non-light absorbing polymeric optical filter agent having attached directly or indirectly to the backbone thereof the following hydrazone moiety:

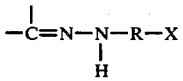

where R is a group which provides a carbon-to-carbon double bond for conjugation with the

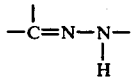

portion of the moiety to provide said light-absorbing capability for the moiety at a pH above the pKa of the moiety and X represents a substituent of R providing at least one electron-withdrawing group.

57. The photographic product of claim 56 wherein R of said polymeric optical filter agent conforms to one of the following structural formulae:

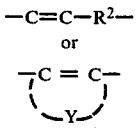

where $R^2$ represents a divalent hydrocarbon moiety or a divalent moiety comprising a carbocyclic or heterocyclic ring structure and Y represents the atoms necessary to complete a carbocyclic ring structure, a heterocyclic ring structure or a fused polycyclic ring structure.

58. The photographic product of claim 56 wherein said polymeric optical filter agent comprises recurring units of the formula

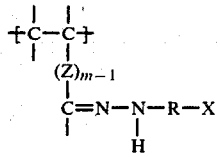

where Z is a divalent radical and m is an integer 1 or 2.

59. The photographic product of claim 58 wherein said R group is

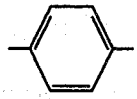

and said electron-withdrawing X group is halogen, halogen-substituted alkyl, nitro or

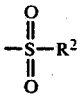

where $R^2$ is alkyl, aryl, substituted-alkyl or substituted aryl.

60. The photographic product of claim 56 wherein said polymeric optical filter agent conforms to the structure

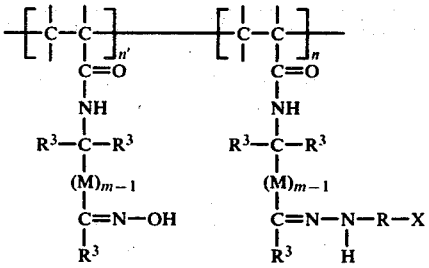

where each $R^3$ is alkyl of from 1 to 6 carbon atoms, M is an alkylene radical having from 1 to 6 carbon atoms, m is an integer 1 or 2 and each of n and n' represents the molar proportion of the respective recurring unit of the polymer backbone.

61. The photographic product of claim 60 wherein said R group is

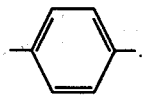

62. The photographic product of claim 60 wherein of said polymeric optical filter agent is from about 5 to about 80 mole percent and n' is from about 20 to about 95 mole percent.

63. The photographic product of claim 56 wherein said transparent layer containing said substantially non-light absorbing polymeric optical filter agent is positioned intermediate said photosensitive element and an image-receiving element through which each silver halide emulsion layer of said photosensitive element is photoexposed.

64. The photographic product of claim 63 wherein there is included means for reducing the environmental pH of said film unit after photoexposure of said photosensitive element and application of an aqueous alkaline processing composition from a pH above the pKa of said polymeric optical filter agent to a predetermined pH below the pKa of said polymeric optical filter agent.

65. The photographic product of claim 56 wherein said photosensitive element includes at least two selectively sensitized silver halide emulsion layers, each having associated therewith a dye which is a silver halide developing agent of predetermined color, each of said dyes being soluble and diffusible in alkaline processing composition as a function of the point-to-point degree of exposure of the respective emulsion associated therewith at a first pH and substantially nondiffusible in said alkaline processing composition at a second pH.

66. The photographic product of claim 65 wherein said photosensitive element includes, as essential layers, in sequence on an opaque support layer, an alkaline solution permeable polymeric layer containing a cyan dye; a red-sensitive silver halide emulsion layer; an alkaline solution permeable polymeric layer containing a magenta dye; a green-sensitive silver halide emulsion layer; an alkaline solution permeable polymeric layer containing a yellow dye; a blue-sensitive silver halide emulsion layer, each of said cyan, magenta and yellow dyes being silver halide developing agents and being soluble and diffusible, in aqueous alkaline solution at said first pH and substantially insoluble in aqueous alkaline solution at said second pH.

67. The photographic film unit of claim 1 wherein said polymeric optical filter agent comprises recurring backbone units having pendant moieties containing said hydrazone moiety.

68. The photographic film nit of claim 12 wherein said polymeric optical filter agent comprises recurring backbone units having pendant moieties containing said hydrazone moiety.

69. The photographic process of claim 28 wherein said polymeric optical filter agent comprises recurring backbone units having pendant moieties containing said hydrazone moiety.

70. The photographic process of claim 40 wherein said polymeric optical filter agent comprises recurring backbone units having pendant moieties containing said hydrazone moiety.

71. The photographic product of claim 56 wherein said polymeric optical filter agent comprises recurring backbone units having pendant moieties containing said hydrazone moiety.

* * * * *